US012674447B2

(12) United States Patent
Bubb et al.

(10) Patent No.: US 12,674,447 B2
(45) Date of Patent: Jul. 7, 2026

(54) DIAPHRAGM FASTENING TO THE DRIVE OF METERING PUMPS

(71) Applicant: ProMinent GmbH, Heidelberg (DE)

(72) Inventors: Alexander Bubb, Plankstadt (DE); Christian Arnold, Weinheim (DE); Tobias Winkler, Sandhausen (DE)

(73) Assignee: ProMinent GmbH, Heidelberg (DE)

( * ) Notice: Subject to any disclaimer, the term of this patent is extended or adjusted under 35 U.S.C. 154(b) by 0 days.

(21) Appl. No.: 18/953,174

(22) Filed: Nov. 20, 2024

(65) Prior Publication Data

US 2025/0163905 A1 May 22, 2025

(30) Foreign Application Priority Data

Nov. 21, 2023 (DE) ..... 102023132443

(51) Int. Cl.
*F04B 43/02* (2006.01)
*F04B 13/00* (2006.01)

(52) U.S. Cl.
CPC ..... *F04B 43/02* (2013.01); *F04B 13/00* (2013.01)

(58) Field of Classification Search
CPC ..... F04B 13/00; F04B 43/0009; F04B 43/02
See application file for complete search history.

(56) References Cited

U.S. PATENT DOCUMENTS 5,074,757 A * 12/1991 Horn ..... F04B 43/009 417/63
6,883,417 B2 * 4/2005 Headley ..... F04B 43/0054 92/99
11,415,122 B2 * 8/2022 Freissler ..... F04B 43/009
11,754,181 B2 * 9/2023 Grossman ..... F04B 43/026 92/96
2017/0241384 A1 * 8/2017 Mizui ..... F04B 17/05
2020/0325886 A1 * 10/2020 Freissler ..... F04B 43/0081
2024/0280095 A1 * 8/2024 Giles ..... F04B 43/0736
2025/0319240 A1 * 10/2025 McGill ..... A61M 1/16

FOREIGN PATENT DOCUMENTS

EP 3851674 A1 * 7/2021 ..... F04B 43/026

OTHER PUBLICATIONS

EP-3851674-A1 English Translation (Year: 2021).*

* cited by examiner

*Primary Examiner* — Anthony Ayala Delgado
(74) *Attorney, Agent, or Firm* — SZDC Law PC

(57) ABSTRACT

The present invention relates to a metering pump comprising (i) a diaphragm return device comprising tie rod and (ii) a diaphragm assembly comprising a mechanically driven elastic diaphragm having a flexible region between the clamping surface, which serves to seal the delivery chamber, at the periphery of the diaphragm and a diaphragm core which serves for force transmission, pressure generation and for connection to the tie rod, characterized in that the diaphragm assembly and the tie rod are connected by means of a hook coupling, or a plug-in coupling, or a clamping connection.

19 Claims, 16 Drawing Sheets

Figures 1, 1A:
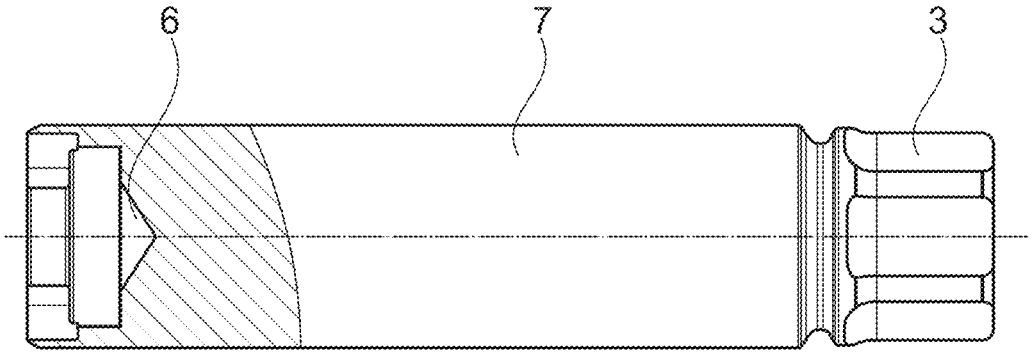

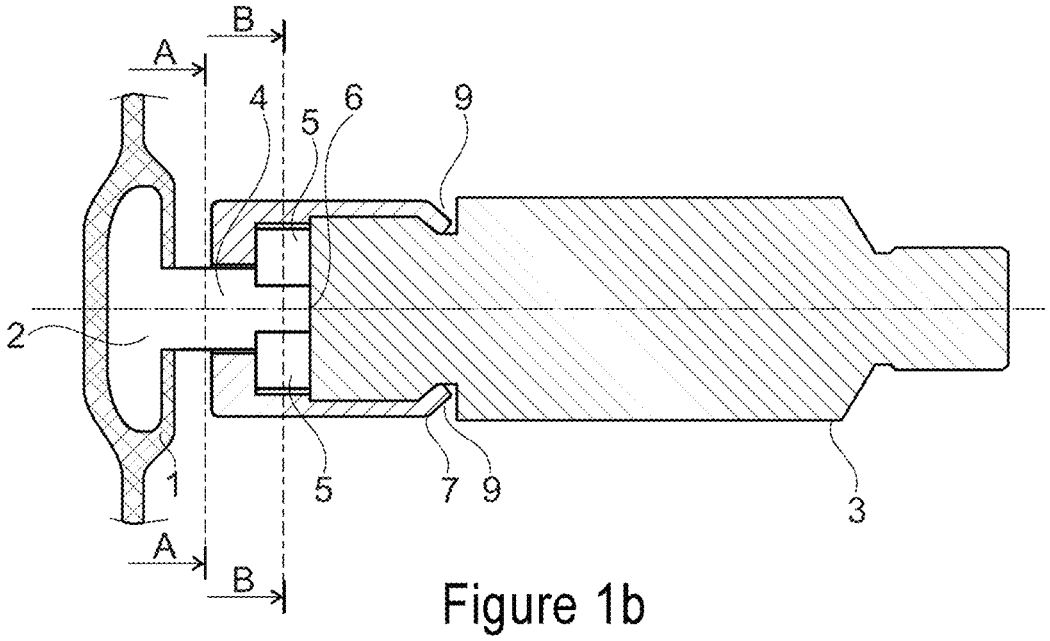
Figure 1b
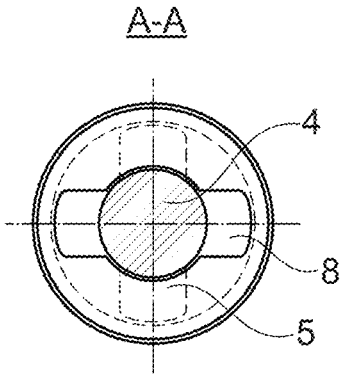
Figure 1b-A
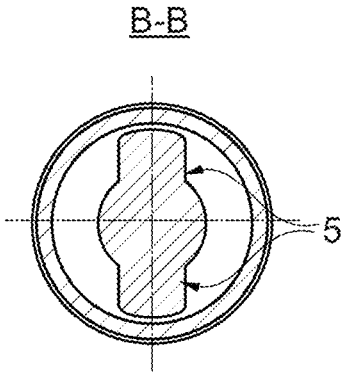
Figure 1b-B

A-A

DIAPHRAGM FASTENING TO THE DRIVE OF METERING PUMPS

This application claims priority to German Patent Application No. DE 102023132443.8, filed on Nov. 21, 2023, which is incorporated by reference for all purposes as if fully set forth herein.

The present invention relates to the fastening of the diaphragm of metering pumps to the drive thereof.

In the prior art, various types of pumps are known under different designations, which are designated according to their technical construction or their function, for example piston pumps, metering pumps, diaphragm pumps, etc.

In the case of a reciprocating piston pump, for example, use is made of a mechanically operated piston running in a cylinder. This piston is combined with a feed and a discharge, which are each closed by a valve. In the first stroke, during intake, the piston moves in such a way that the volume in the cylinder increases and thus, with the inlet valve open, delivery fluid flows into the cylinder. The inlet valve is subsequently closed and the outlet valve opened, and the piston moves in the cylinder in such a way that the volume in said cylinder decreases again and thus the delivery fluid exits the outlet valve.

By contrast, hydraulically operated diaphragm pumps have a delivery chamber having a suction connection and a pressure connection, and a hydraulic chamber which is separated from the delivery chamber by a diaphragm. In order to deliver a medium, the diaphragm is moved back and forth in an oscillating manner between a first and second position by virtue of the hydraulic chamber being filled with a hydraulic fluid to which an oscillating pressure is applied by a piston. The two positions of the diaphragm are usually referred to as pressure stroke position and as suction stroke position.

Usually, the pressure connection is connected to the delivery chamber by way of a pressure valve which is in the form of a check valve and the suction connection is connected to the delivery chamber by way of a suction valve which is also in the form of a check valve. When the diaphragm is moved from the first position into the second position, what is known as the suction stroke, the volume of the delivery chamber is increased, as a result of which the pressure in the delivery chamber falls. As soon as the pressure in the delivery chamber falls below the pressure in a suction line connected to the suction connection, the suction valve opens and medium to be delivered is sucked into the delivery chamber via the suction connection. As soon as the diaphragm is moved from the second position back in the direction of the first position (what is known as the pressure stroke), the volume in the delivery chamber decreases and the pressure in the delivery chamber increases. The suction valve is closed in order to prevent the medium to be delivered from flowing back into the suction line. As soon as the pressure in the delivery chamber exceeds the pressure in a pressure line connected to the pressure connection, the pressure valve is opened, with the result that the delivery medium located in the delivery chamber can be forced into the pressure line.

Applying an oscillating pressure to the hydraulic fluid thus leads to an oscillatory movement of the diaphragm and, associated therewith, to an oscillatory pumping operation for the delivery fluid out of the suction line into the pressure line.

Hydraulically operated diaphragm pumps are preferably used when delivering delivery fluids under high pressures, since the hydraulic fluid loads the diaphragm uniformly and the latter thus has a long service life.

The diaphragm can have a diaphragm return device in the form of a tie rod, which has an assisting action in the direction of the suction stroke position.

In the case of hydraulically operated diaphragm pumps, the term "tie rod" has been established for the diaphragm return device. In the case of mechanically driven diaphragm pumps, the term "thrust rod" is usually used for the corresponding component, since the diaphragm is pushed during the pressure stroke.

The diaphragm itself generally comprises multiple layers, usually two polytetrafluoroethylene (PTFE) layers which enclose a fabric layer in a sandwich construction.

The diaphragm also comprises a diaphragm core which has a receptacle for the tie rod. The diaphragm core is generally made of metal, but may also be manufactured from suitable plastic.

Usually, what is known as a diaphragm assembly is formed together with a diaphragm retaining disc, attached to the end side of the tie rod, and a clamping screw, which fix the aforementioned layers.

In order to connect the diaphragm assembly to the tie rod (or thrust rod), various solutions are described in the prior art. It is for example known for the diaphragm assembly to have a threaded extension which is screwed into the tie rod as far as a fixed stop. A key prevents co-rotation of the tie rod.

A disadvantage with this solution is that a thread may be broken in the event of improper installation. Furthermore, it is disadvantageous that recourse has to be had to a specific tool and the diaphragm itself can be damaged during the assembly by means of this tool. Furthermore, it is disadvantageous that an additional component is required in order to prevent co-rotation of the tie rod. In addition, thread pairings made of metal (shaft/core) can corrode in aggressive pump environments and then are releasable only with difficulty.

The converse variant of a screw connection is also known in the prior art. Here, the diaphragm assembly does not have a threaded extension, instead the threaded extension is provided by the tie rod. However, this known embodiment does not overcome the listed disadvantages of the screw connection formed by the diaphragm assembly. Here, too, recourse must be had to a special tool in order to screw the diaphragm assembly onto the threaded extension.

Documents which disclose the fastening of the diaphragm assembly to the tie rod by means of screw connection are for example DE 10 2019 109283 A1, DE 3931516 C2, DE 10 2005 039772 A1, DE 10 2011 105000 A1 and WO 2011/101118 A1.

Furthermore, the fastening of the metering diaphragm to the tie rod by means of a coupling is known from the prior art (DE 1653586 C3). An additional coupling makes the pump more expensive.

A further option is to connect the metering diaphragm to the tie rod by means of a ball connection, hook connection or T-groove connection integrated into said tie rod and the diaphragm core. However, this type of connection is very expensive owing to the high accuracy requirements. The diaphragm must also be assembled laterally in this case. However, in many delivery units lateral diaphragm assembly is not possible at all owing to an excessively small cutout in the drive housing.

As an alternative, it is known from the prior art for the diaphragm layers to be retained directly by the diaphragm disc and the tie rod, without the diaphragm assembly comprising a clamping screw. The tie rod also fulfils the function of the clamping screw. This solution leads to the situation where either the tie rod also has to be replaced when the diaphragm is changed or the diaphragm assembly must be correctly braced, adhesively bonded and provided with separating means on site.

Furthermore, plug-in connections, rotary connections or bayonet connections of diaphragm and tie rod are known from the prior art (for example from DE 10 2004 035651 A1). The angular positioning of the diaphragm is able to be realized only with difficulty in this case. High accuracy of the components is also necessary.

Clamping connections are also widely used in the art. Examples of use are disclosed by documents DE 20 2015 103406 U1 and EP 3660380 A1. Disadvantages of the connections of the prior art consist in their complexity, high space requirement and complicated assembly.

It is therefore the object of the present invention to overcome the disadvantages of the prior art and in particular to provide a secure connection of diaphragm assembly and tie rod which manages without screw connection, does not require complicated assembly, enables easy angular positioning of the diaphragm and in which the risk of damage to the diaphragm during the assembly is minimized.

This object is achieved by means of a diaphragm pump having a diaphragm assembly and a diaphragm return device comprising a tie rod, wherein the diaphragm assembly and the tie rod are connected by means of (i) a hook coupling, or (ii) a plug-in coupling, or (iii) a particular clamping connection.

Here, the diaphragm is coupled to the tie rod by axial or obliquely lateral insertion and rotation.

In a first embodiment, the diaphragm assembly and the tie rod are connected by a hook coupling.

A subject of the invention is thus a metering pump comprising a mechanically driven elastic diaphragm having a flexible region between the clamping surface, which serves to seal the delivery chamber, at the periphery of the diaphragm and a diaphragm core which serves for force transmission, pressure generation and for connection to the tie rod, wherein

- the diaphragm core is provided, in the direction of the tie rod, with a preferably cylindrical connection piece which preferably bears two oppositely positioned tabs at the end,
- the tie rod is provided on the end side with an axial turned-out portion for receiving the connection piece tabs, and
- the tie rod is equipped with a coupling sleeve which has a radial transverse-groove opening, wherein the opening serves for the plugging therethrough, and then rotation, of the connection piece tabs.

As a result of the rotation of the diaphragm, the tabs of the screw-in connection piece are arrested and non-releasably connected with respect to the coupling sleeve.

Usually, hook couplings have axial play of up to 0.05 mm between the connecting parts. Bracing of the connection and thus freedom from play is enabled by an oblique (1°-3°) tab surface. This freedom from play is necessary for proper diaphragm function and avoidance of stroke length losses of the pump. At the same time, the play-free connection ensures that no movement of the two surfaces relative to one another and thus no wear occurs.

The non-releasable fastening of the coupling sleeve to the tie rod may be produced, for example, by flanging, clinching (forming), pressing, pinning, screwing, welding or adhesive bonding, preferably by flanging or screwing. During the operation of the pump, loosening of the fastening of the coupling sleeve to the tie rod may possibly occur. Therefore, tie rod and coupling sleeve are particularly preferably not produced as separate parts and then connected to one another, but rather are produced in one piece, either from metal by machining or from suitable plastic in an injection moulding method.

In one embodiment, coupling sleeve and tie rod are thus produced as one piece (embodiment 1a). In this case, the production is preferably effected by machining from metal, preferably from heat-treated steel (e.g. material number 1.7225), case hardening steel (e.g. material number 1.7147) or stainless steel (e.g. material number 1.4462, 1.4122 or 1.4305). However, the one-piece combination of coupling sleeve and tie rod particularly preferably consists of plastic or of a composite of steel and plastic. In such a composite, the tie rod preferably consists of metal, preferably of one of the aforementioned steels, and the coupling sleeve consists of plastic. A typical plastic used here is glass-fibre-reinforced polyphenylene sulfide (PPS), the glass fibre content typically making up about 40% of the total plastics compound. The plastic is preferably processed in an injection moulding method. However, other processing techniques are also possible.

In a further embodiment, the coupling sleeve is connected to the tie rod by flanging (embodiment 1b).

In a further embodiment, the coupling sleeve is screwed directly to the tie rod (embodiment 1c).

In a further embodiment, the coupling sleeve is fastened to the tie rod with screws (embodiment 1d).

The transmission of force to the diaphragm core is effected in a positively locking manner via the end faces of tie rod and coupling sleeve during the pressure stroke, and via surfaces of the connection piece tabs, said surfaces facing towards the tie rod, and the shoulder of the coupling sleeve during the suction stroke.

In the case of the coupling of a diaphragm to a sensor region (tab) for indicating a break, like diaphragms according to EP 2180185 A2 or EP 1384891 A1, the exact correlation of the angular position of the diaphragm tab with respect to the connection piece tab can be very easily ensured during the diaphragm production. The diaphragm tab is positioned under the sensor in an exact and unproblematic manner during pump assembly. The hooked-in diaphragm core can compensate for a greater radial angular error of the diaphragm tab than is the case for directly screwed diaphragms, and thus can make the angular positioning of the diaphragm easier.

Since the coupling of the diaphragm is effected by axial plugging-in and rotation, the diaphragm also no longer has to be laterally assembled, as is the case for common hook connections. This invention can thus also be used in the case of small delivery units and small diaphragm retaining plates. A diaphragm retaining plate is an adapter disc attached to the drive (tie rod), in order to be able to assemble diaphragms of different size.

In a further embodiment, the diaphragm assembly and the tie rod are connected by a plug-in coupling.

A further subject of the invention is thus a metering pump comprising a mechanically driven elastic diaphragm having a flexible region between the clamping surface, which serves to seal the delivery chamber, at the periphery of the diaphragm and a diaphragm core which serves for force transmission, pressure generation and for connection to the tie rod, wherein the diaphragm core is provided, in the direction of the tie rod, with a preferably cylindrical coupling member, wherein the coupling member has a groove, the tie rod is provided on the end side with a first (axial) opening for receiving the coupling member, and the tie rod has a second (radial) opening which is used for the fixing of the coupling member.

The transmission of force to the diaphragm core is effected in a positively locking manner via the end faces of the tie rod during the pressure stroke, and via the laterally hooked-in surface of the coupling member during the suction stroke. The hooked-in diaphragm core can be radially rotated and thus enables the angular positioning of the diaphragm.

"Old" diaphragms provided with a threaded bore can also be equipped with the coupling member and also brought to the coupling technique according to the invention.

The coupling member is preferably connected to the diaphragm core by screwing. However, it is also possible for diaphragm core and coupling member to be manufactured in one piece.

To remove the diaphragm, the fixing of the coupling member is cancelled. Thereafter, coupling member and diaphragm core can be pulled out.

In a preferred embodiment (embodiment 2a), the fixing of the coupling member is effected by means of a displaceable component which is arranged in the tie rod and engages "in a lock-like manner" into the groove of the coupling member due to the pressure of a compression spring. The force of the compression spring moves the displaceable component constantly upwards. After the component has been engaged, the coupling member is locked. Thereafter, a possibly present sensor region (tab) for indicating a break is oriented on the diaphragm by rotation of the diaphragm. Removal is effected in the reverse order: by means of a pin, which the fitter plugs from the outside through a bore in the diaphragm retaining plate (or in the drive housing), the displaceable component is displaced downwards; the coupling member becomes free and can be pulled out.

In a further preferred embodiment (embodiment 2b), the fixing of the coupling member is effected by means of a clamp coupling, which consists of two spring-braced clamp halves. The clamp coupling is assembled on two parallel transverse grooves of the tie rod. Thereafter, a possibly present sensor region (tab) for indicating a break is oriented on the diaphragm by rotation of the diaphragm. For removal, a flat-headed screwdriver is inserted into the slot in the clamp coupling and rotated by approximately 90° to open the clamp coupling. Thereafter, the diaphragm assembly is pulled out of the tie rod. The clamp coupling remains on the tie rod.

In a further preferred embodiment (embodiment 2c-1), a resiliently mounted ball, such as a resilient pressure piece according to the Ganter Norm®, is introduced, preferably screwed, into a radial transverse bore of the tie rod. The coupling member has an obliquely running transverse groove of variable depth. The coupling member and the tie rod are connected by being plugged into one another and subsequently rotated in opposite directions. During the rotation, the ball dips into the groove until it is engaged in its end position and the coupling member is fixed. For removal, the coupling member and the tie rod are rotated in opposite directions, wherein the ball is forced into its pressure piece (spring) and the fixing is undone.

In an alternative preferred embodiment (embodiment 2c-2), the pressure piece (spring) is introduced not into the tie rod but into the coupling member, and it is the tie rod instead of the coupling member that has a wide transverse groove. The functioning in this embodiment corresponds to that of embodiment 2c-1.

In a further preferred embodiment (embodiment 2d), a respective grub screw (set screw according to DIN 913) is screwed into one or more radial transverse bores of the tie rod. The coupling member has a radially encircling groove for receiving the screw tip. For assembly, the coupling member is plugged into the thrust rod as far as the stop and a possibly present sensor region (tab) for indicating a break is oriented on the diaphragm by rotation of the diaphragm. Thereafter, the grub screw/screws is/are tightened for example using a hex key, wherein the tip/tips of the screw/screws tighten the diaphragm core against the tie rod in a play-free manner. Removal is effected by removing the grub screw/screws.

The freedom from play, provided in this embodiment 2d, of the connection is advantageous for proper function of the diaphragm and the avoidance of stroke length losses of the pump. The play-free connection also ensures that no relative movement of the braced surfaces and thus no wear occurs.

In a further embodiment, the diaphragm assembly and the tie rod are connected by a particular clamping connection.

A further subject of the invention is thus a metering pump comprising a mechanically driven elastic diaphragm having a flexible region between the clamping surface, which serves to seal the delivery chamber, at the periphery of the diaphragm and a diaphragm core which serves for force transmission, pressure generation and for connection to the tie rod, wherein the diaphragm core is provided, in the direction of the tie rod, with a clamping connection piece which is able to be screwed in, and the tie rod is provided with a clamping connection, which has a first clamping hub and optionally a second clamping hub, wherein the first clamping hub is worked into the tie rod itself, and the optional second clamping hub, depending on the embodiment, forms a separate part which is preferably fastened by screwing.

The clamping connection is preferably embodied according to DIN 32676 (what is known as a tri-clamp clamping connection). The connection is therefore less complex and cost-effective.

The transmission of force to the diaphragm core is effected in a play-free manner; in a positively locking manner via the end face of the tie rod during the pressure stroke, and via the clamping connection during the suction stroke. The hooked-in diaphragm core can be radially rotated, before it is clamped, and thus enables the angular positioning of the diaphragm.

The clamping connection piece is either produced as a part with the diaphragm core, or it can be introduced, preferably screwed, as an "adapter bolt" with connection piece into existing diaphragms.

The clamping connection has a clamping angle of preferably approximately 20° (in accordance with DIN 32676). Therefore, although the diaphragm has to be inserted from the side, it can be inserted only slightly obliquely in contrast to the common hook couplings. The clamping connection according to the invention can thus also be used in the case of small diaphragm retaining plates.

In a preferred embodiment (embodiment 3a), the clamping connection has a radially displaceable second clamping hub. For assembly of the diaphragm, the diaphragm core provided with the clamping connection piece is inserted into the clamping groove of the tie rod, the diaphragm is oriented and then the second clamping hub is moved in the groove as far as the stop and fixed with a screw (clamping screw). For removal, the clamping screw is released, the clamping connection is uncoupled as a result, and the diaphragm can be removed.

In a further preferred embodiment (embodiment 3b), the clamping connection has an axially displaceable coupling sleeve which, displaced in the direction of the diaphragm core, clamps the clamping connection piece in the clamping groove worked into the tie rod. A resiliently mounted ball, such as a resilient pressure piece according to the Ganter Norm®, is also introduced, preferably screwed, into a radial transverse bore of the tie rod. A corresponding depression for receiving the ball is located in the coupling sleeve. For assembly of the diaphragm, the diaphragm core provided with the clamping connection piece is inserted into the clamping groove of the tie rod, the diaphragm is oriented and then the coupling sleeve is displaced until the ball engages into the depression and the connection is thus fixed. For removal, the coupling sleeve is pushed back, the clamping connection is uncoupled as a result, and the diaphragm can be removed.

Further features and advantages of the invention will become apparent from the exemplary embodiments below, in which the invention is explained by way of example on the basis of schematic drawings, without thereby limiting the invention.

Figures 1, 1A, 2:
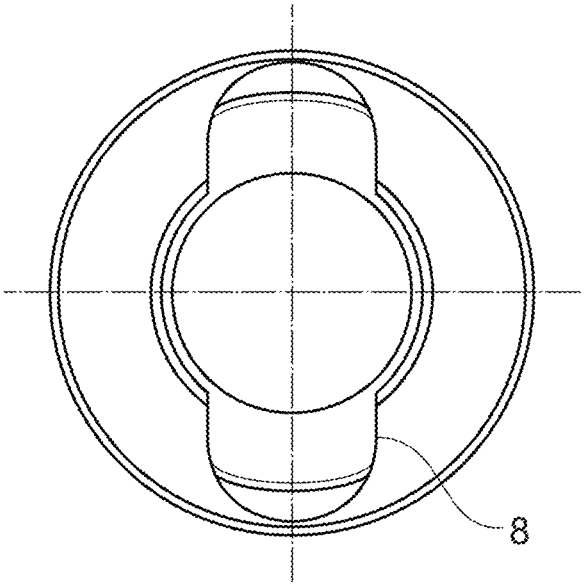
Figures 1, 1A, 2, 3:
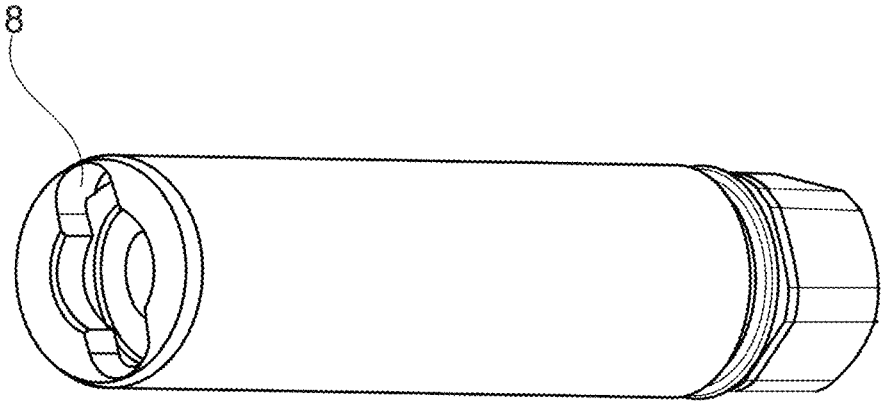
Figure 1C:
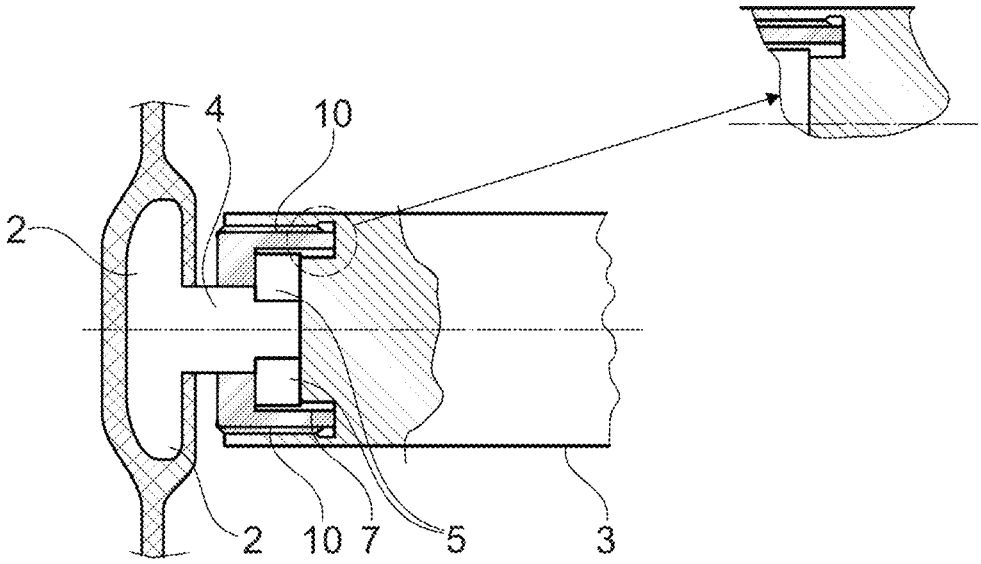
Figure 1D:
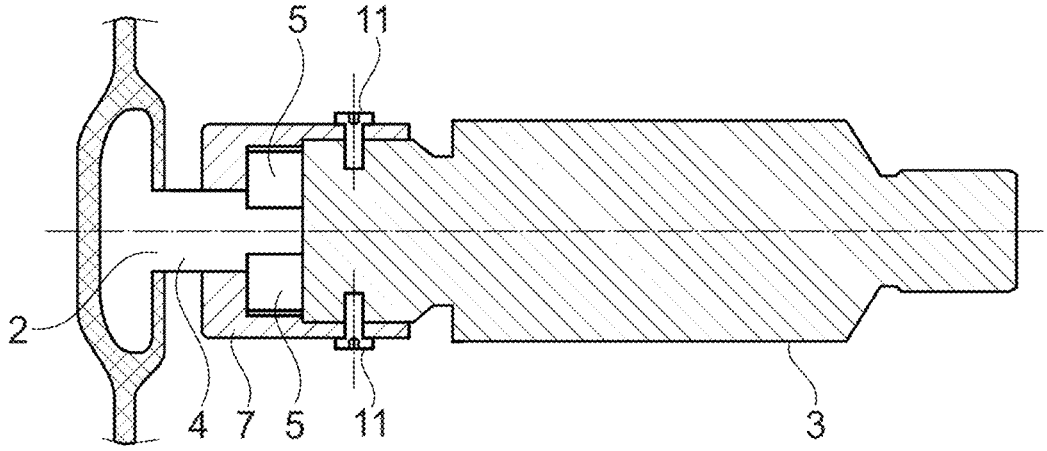
Figure 1E:
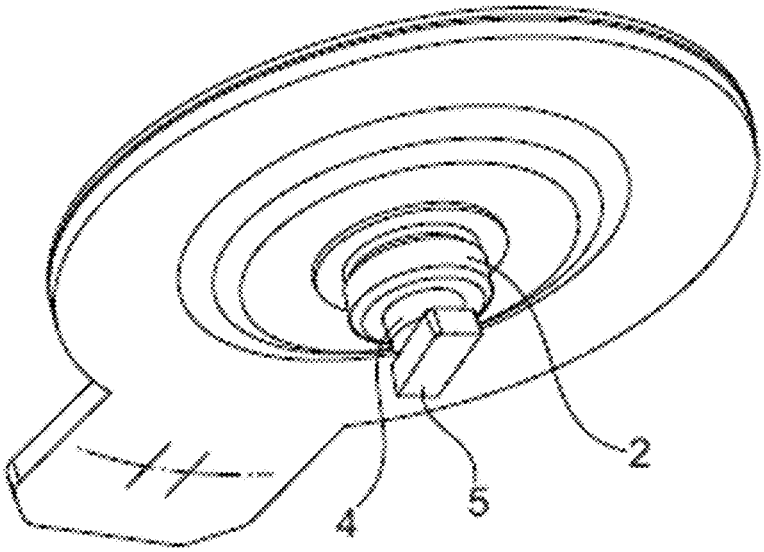
Figures 1, 2A:
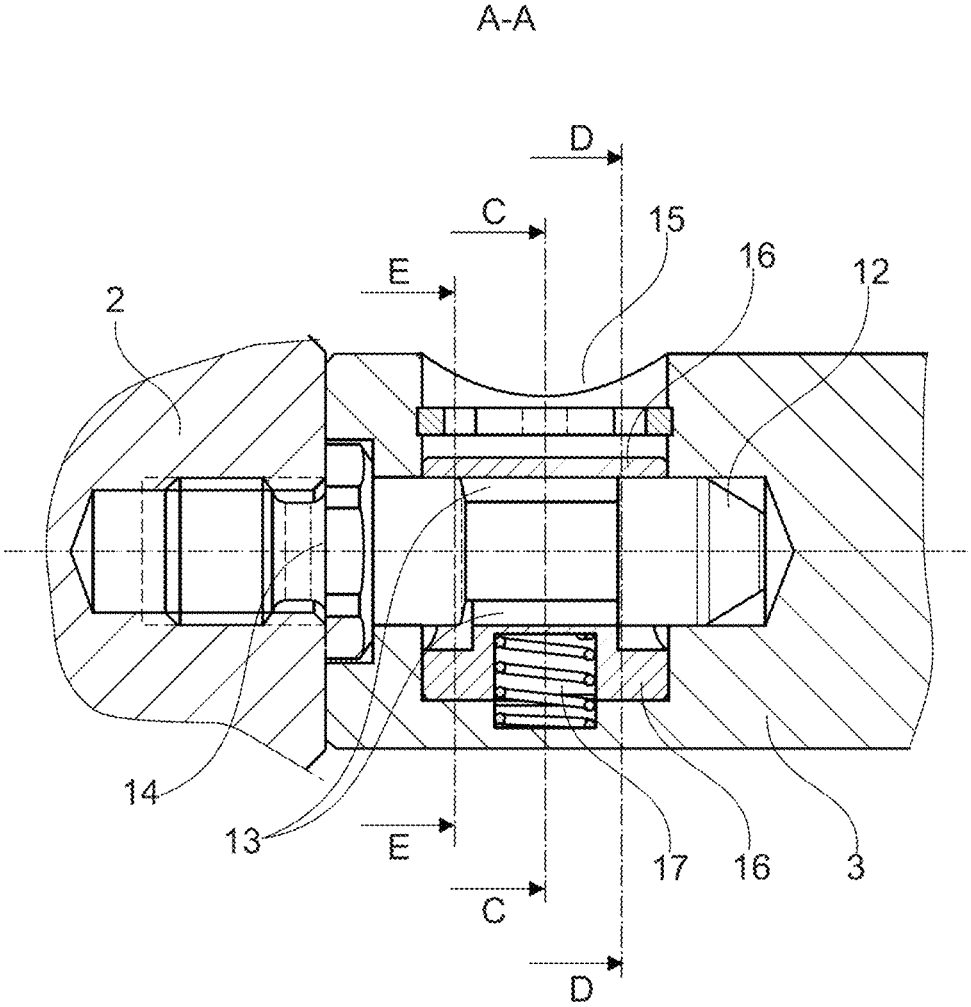
Figures 2, 2A:
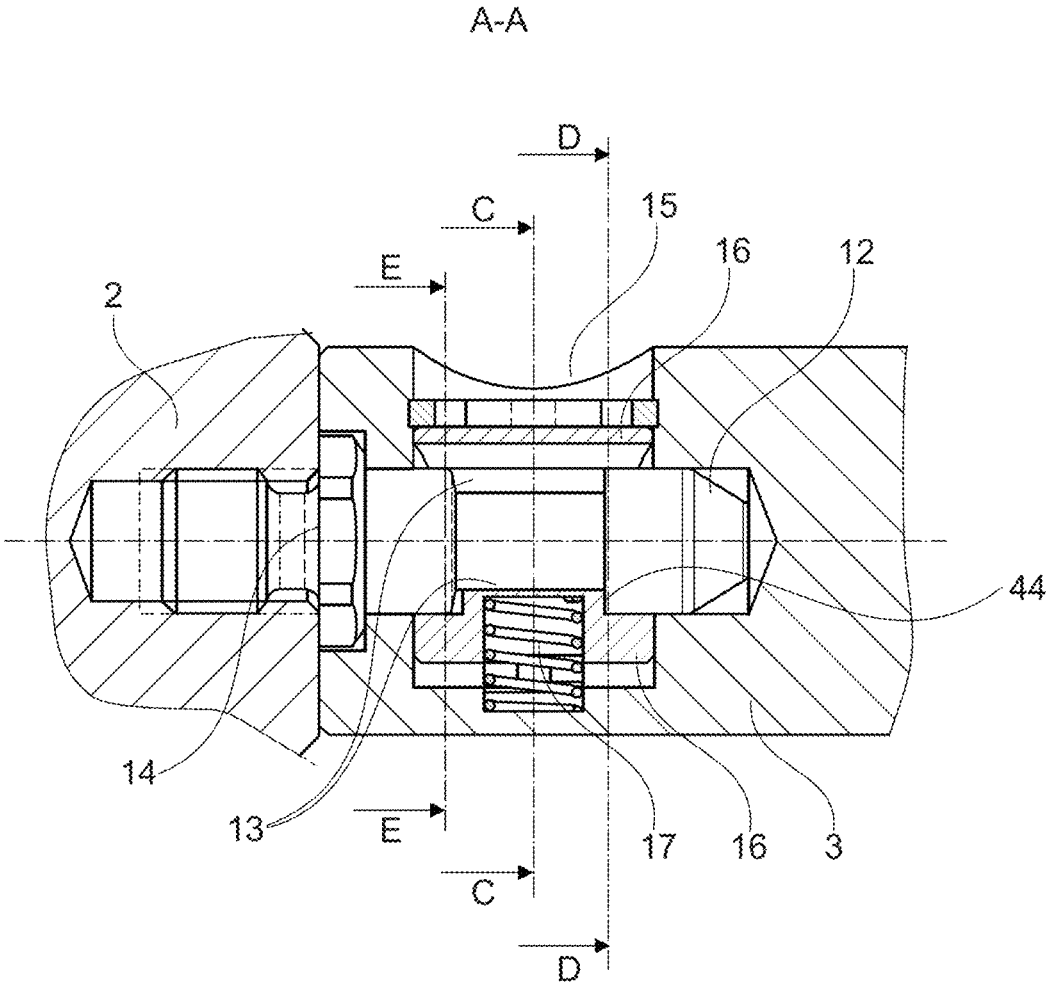
Figures 2, 2A, 3:
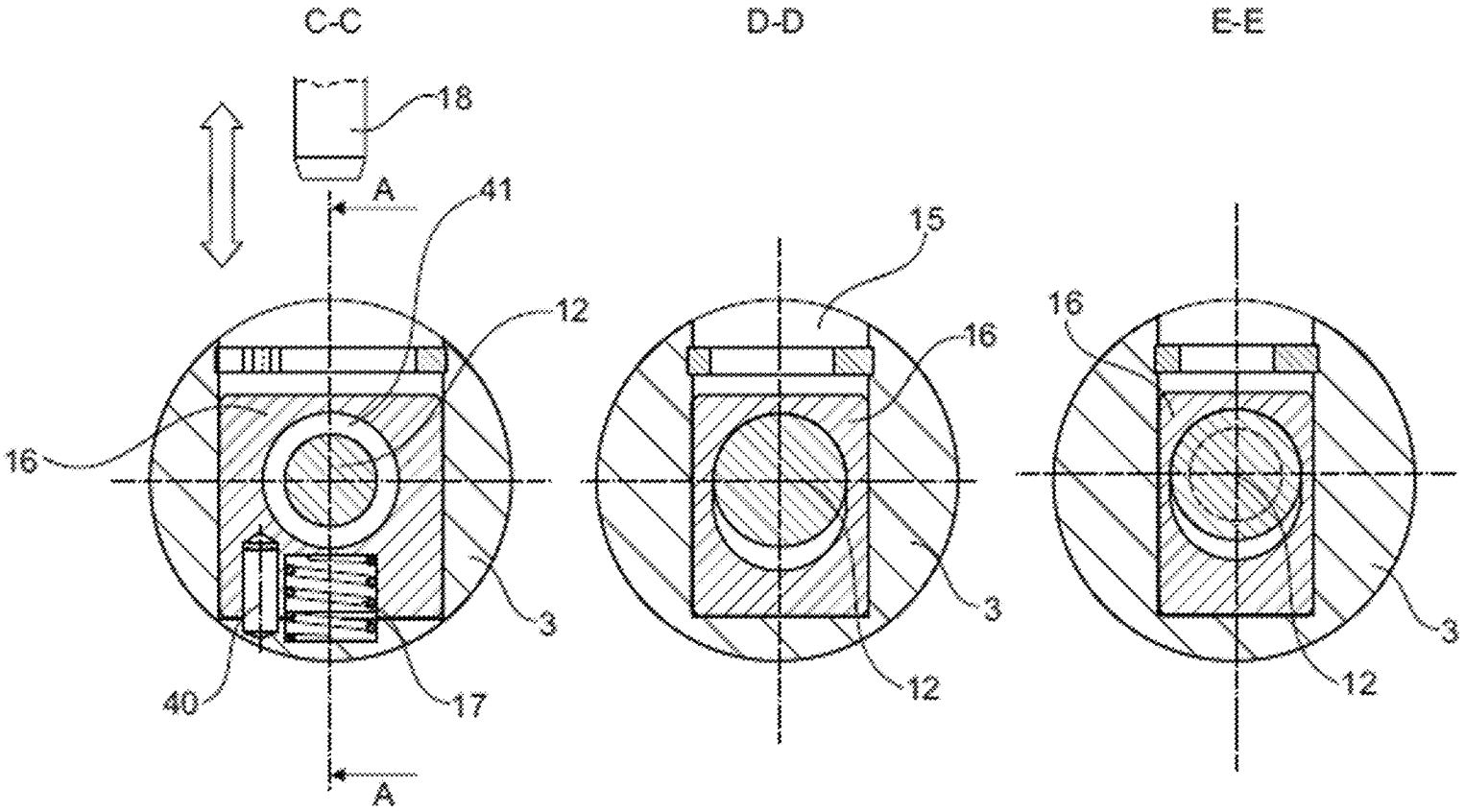
Figures 2, 2A, 3, 4:
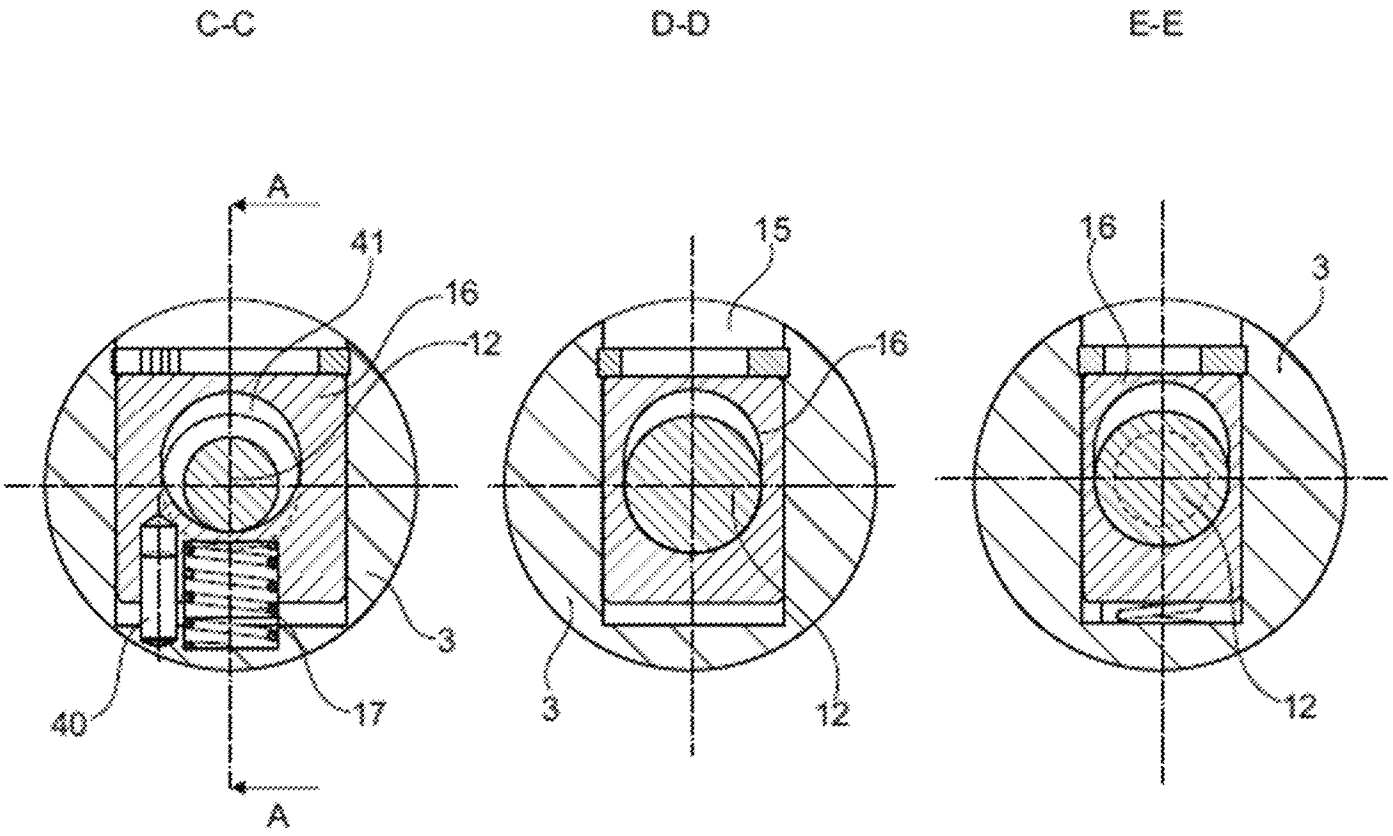
Figures 2, 2A, 3, 4, 5:
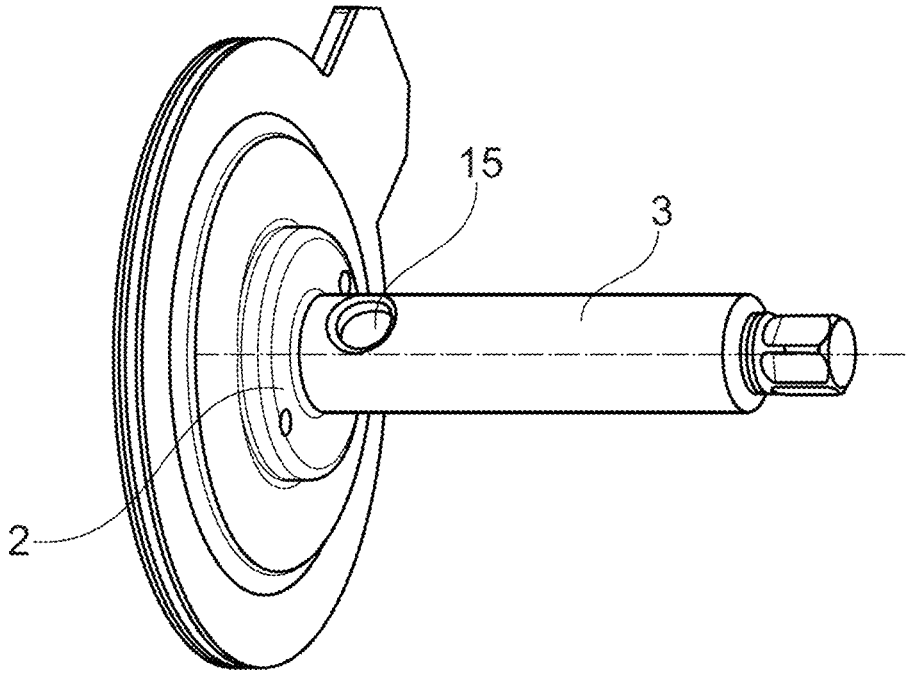
Figures 2, 2A, 3, 4, 5, 6:
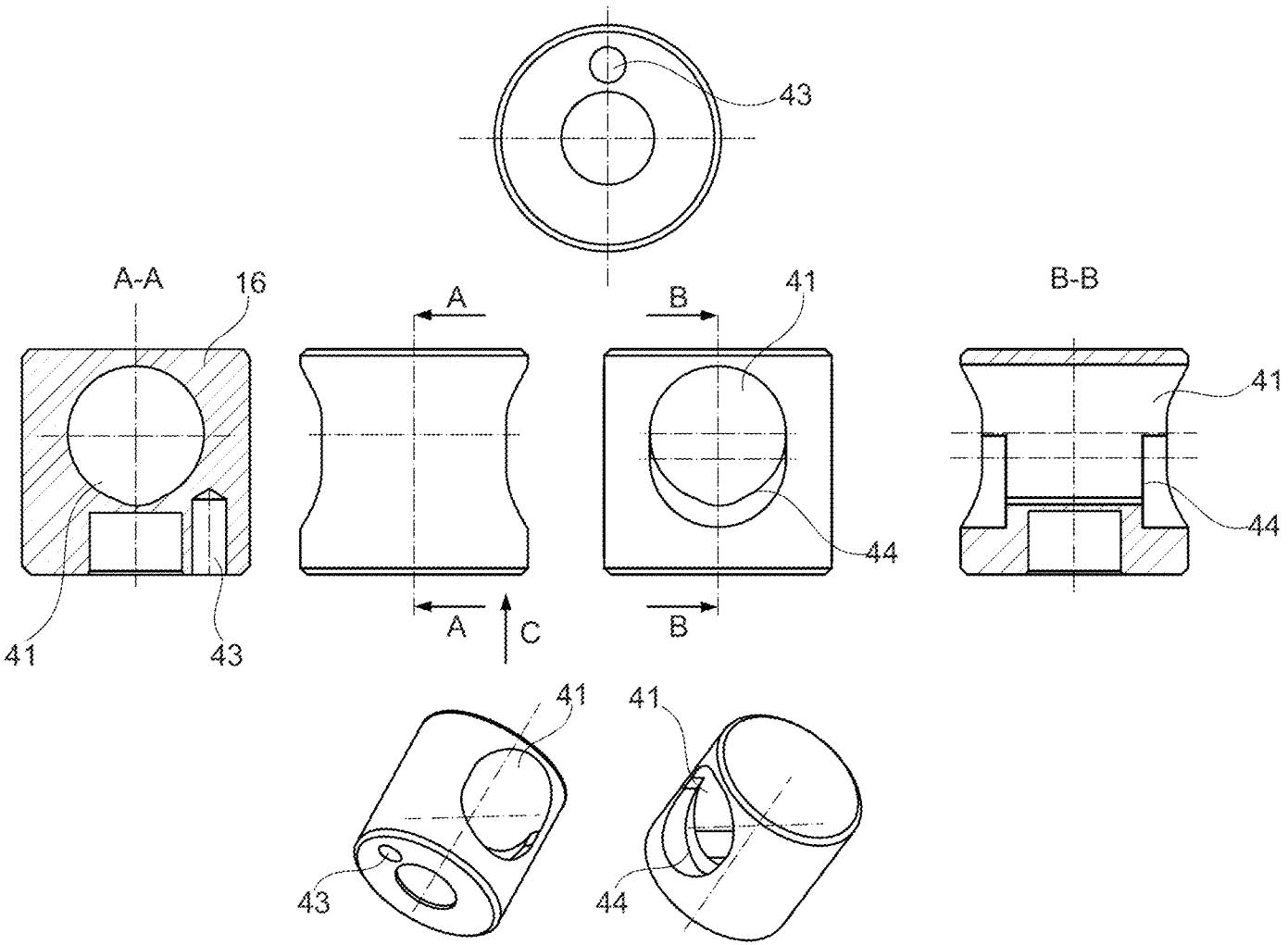
Figure 2B:
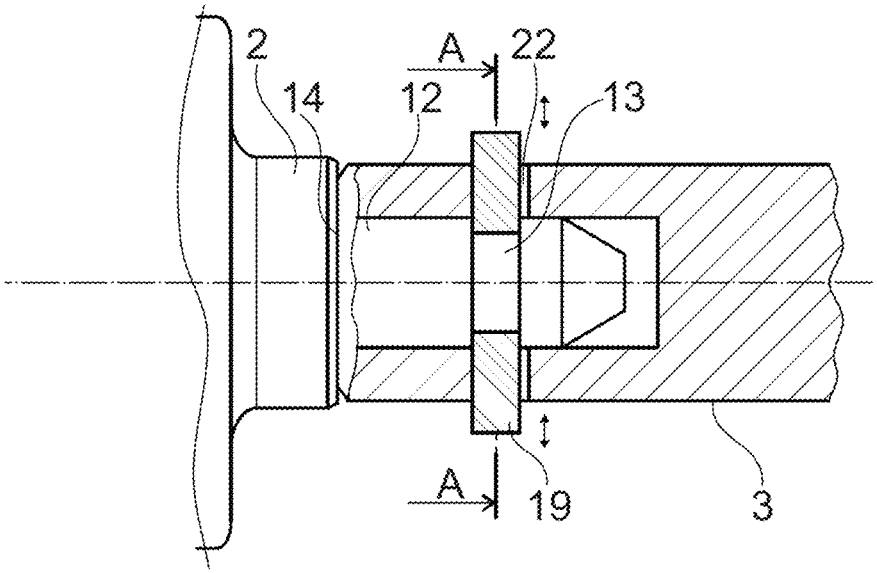
Figures 1, 2B:
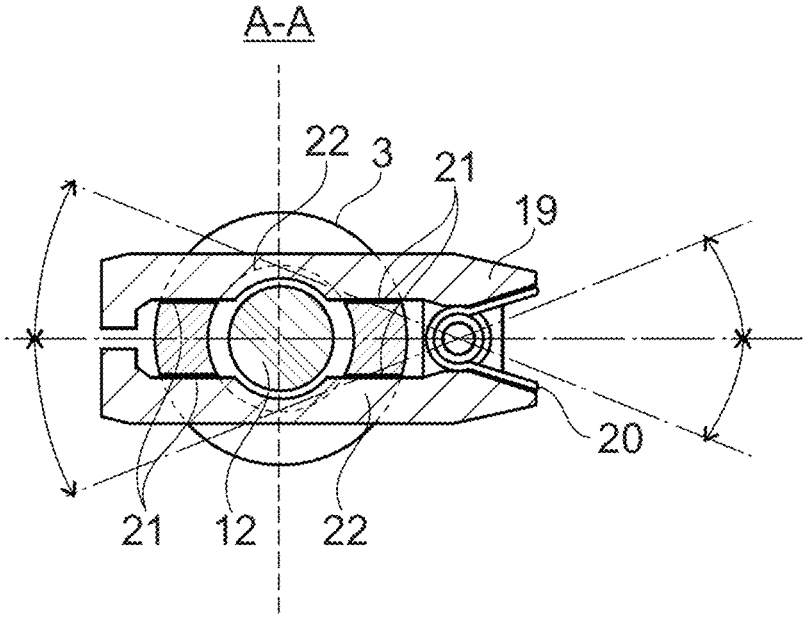
Figures 1, 2C:
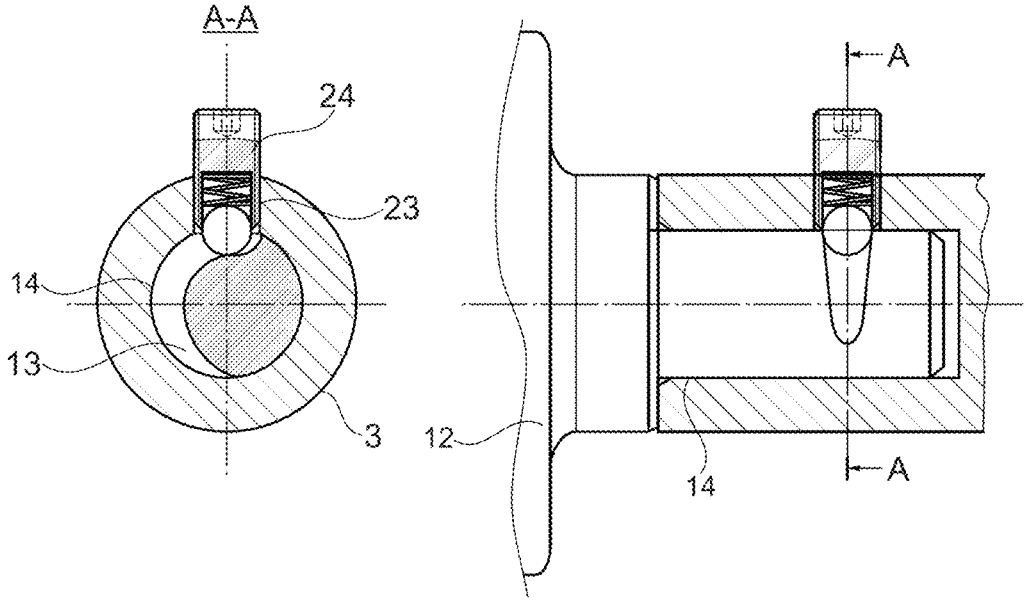
Figures 2, 2C:
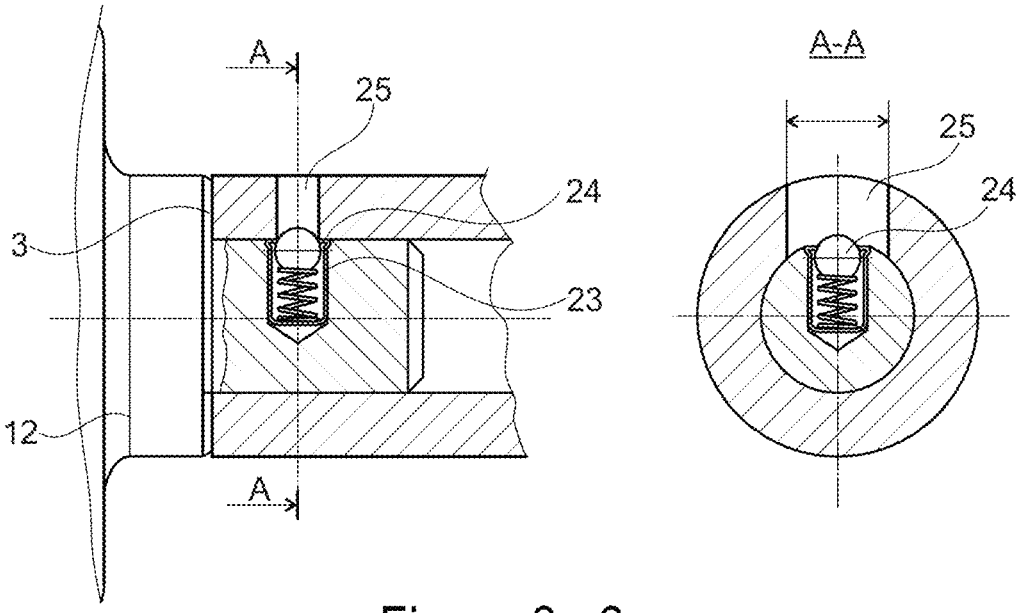
Figure 2D:
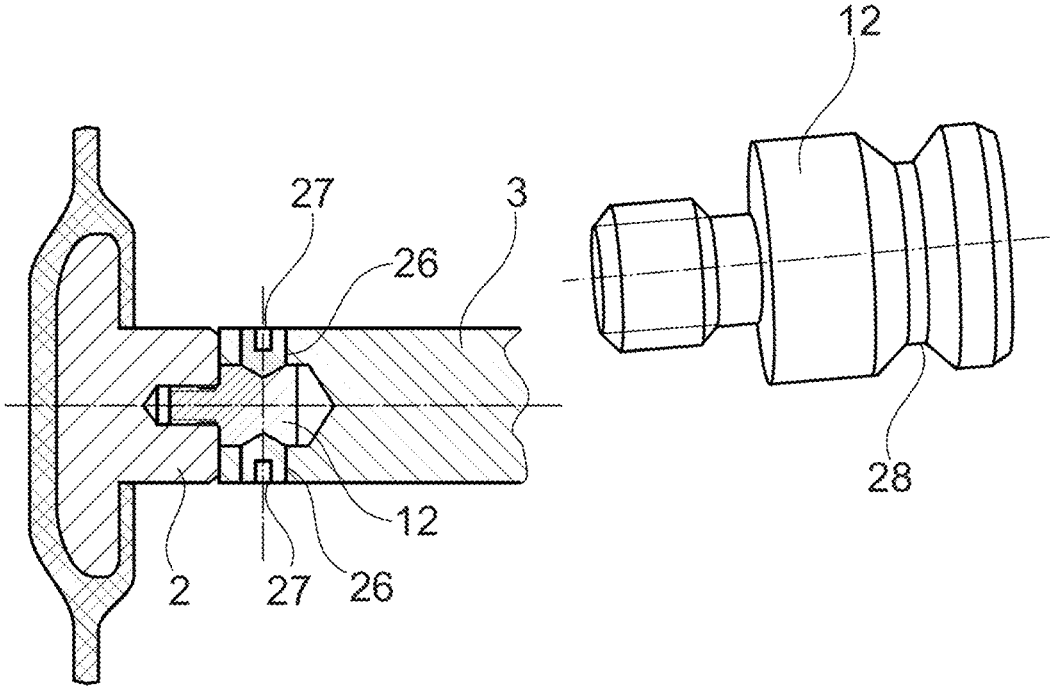
Figure 3A:
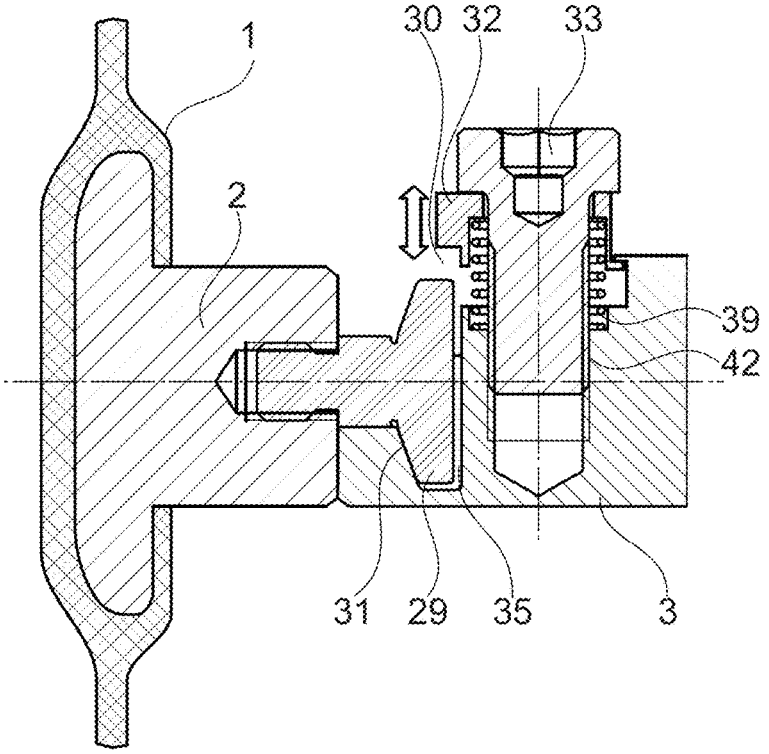
Figure 3A:
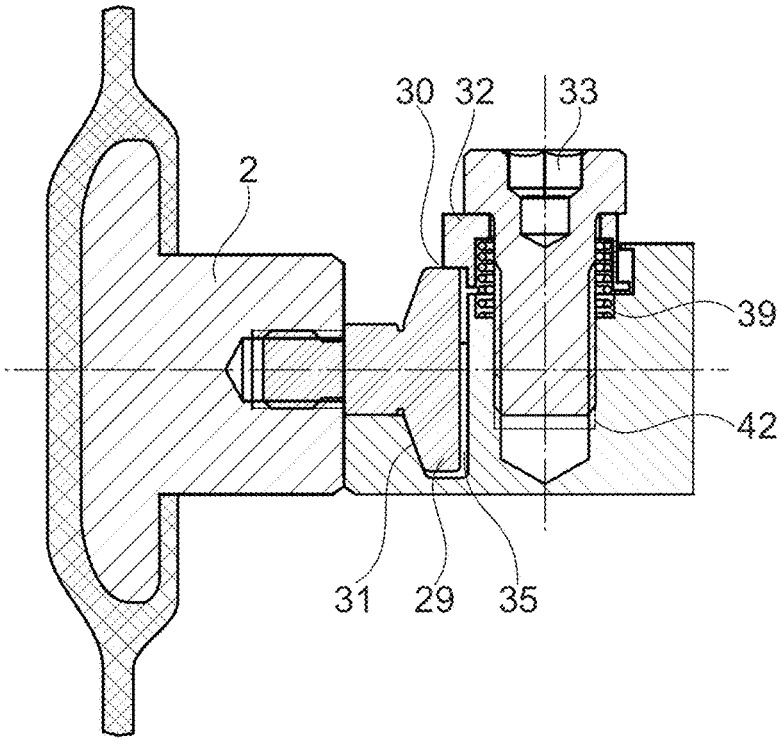
Figure 3B:
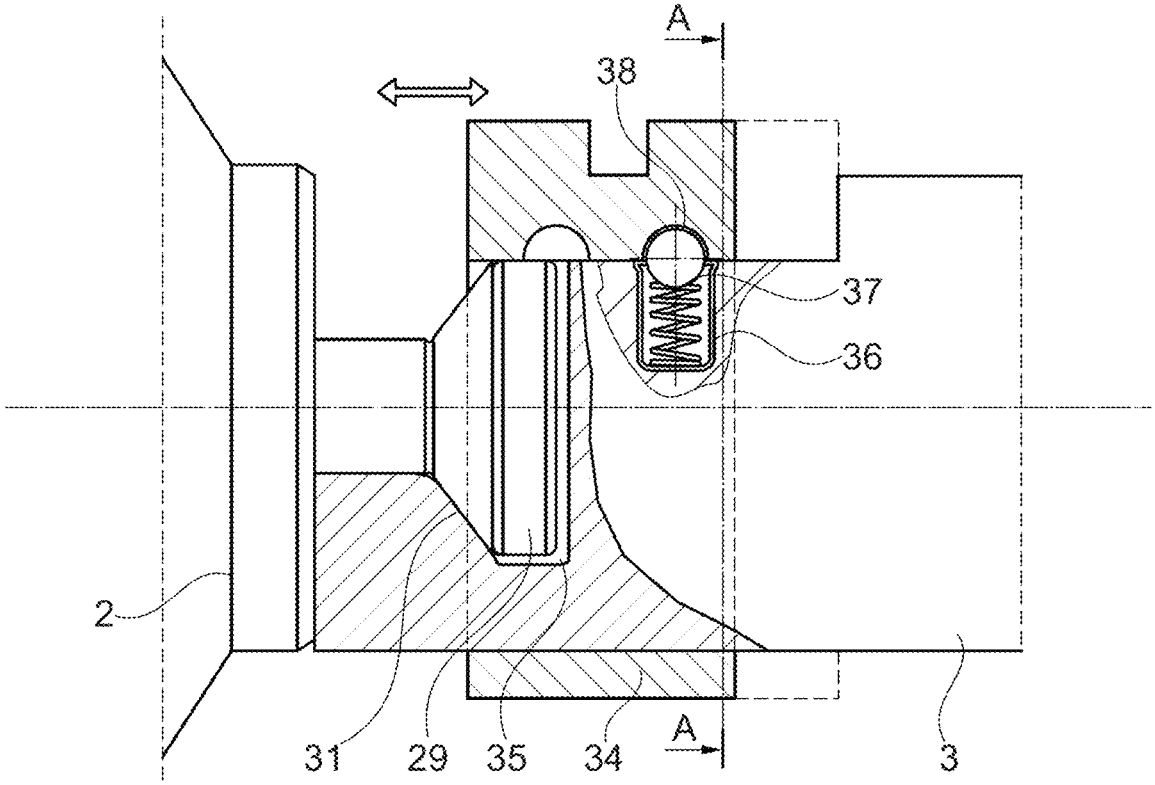
Figure 3B:
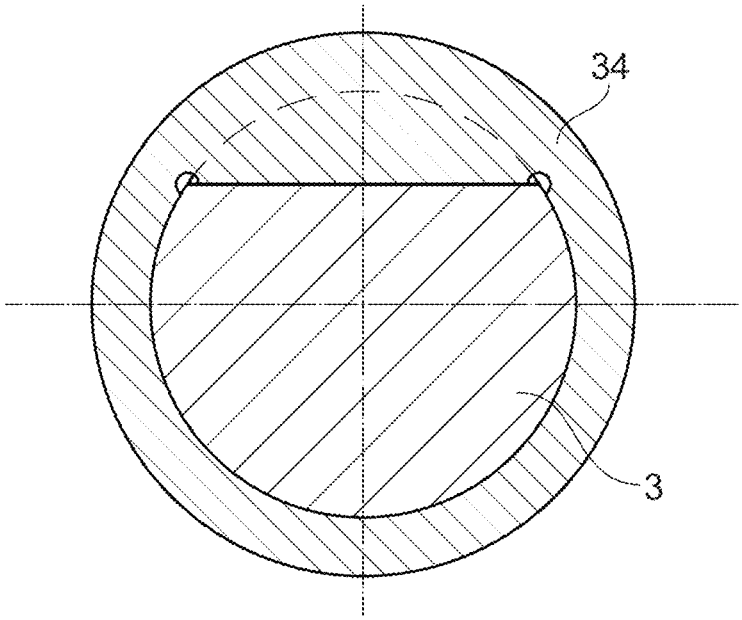

In the drawings:

FIGS. 1*a*-1 to 1*a*-3 show the perspective view of embodiment 1a of a metering pump according to the invention;

FIGS. 1*b*, 1*b*-A and 1*b*-B show the perspective view of embodiment 1b of a metering pump according to the invention;

FIG. 1*c* shows the perspective view of embodiment 1c of a metering pump according to the invention;

FIG. 1*d* shows the perspective view of embodiment 1d of a metering pump according to the invention;

FIG. 1*e* shows the perspective view of a diaphragm according to one of embodiments 1a-1d FIGS. 2*a*-1 to 2*a*-6 show the perspective view of embodiment 2a of a metering pump according to the invention;

FIGS. 2*b* and 2*b*-1 show the perspective view of embodiment 2b of a metering pump according to the invention;

FIG. 2*c*-1 shows the perspective view of embodiment 2c-1 of a metering pump according to the invention;

FIG. 2*c*-2 shows the perspective view of embodiment 2c-2 of a metering pump according to the invention;

FIG. 2*d* shows the perspective view of embodiment 2d of a metering pump according to the invention;

FIG. 3*a* shows the perspective view of embodiment 3a of a metering pump according to the invention; and FIG. 3*b* shows the perspective view of embodiment 3b of a metering pump according to the invention.

FIG. 1*a*-1 to FIG. 1*a*-3 show by way of example a combination, produced as one piece, of coupling sleeve (7) and tie rod (3) according to embodiment 1a of the metering pump according to the invention. The tie rod is provided on the end side with an axial turned-out portion (6) for receiving connection piece tabs. The coupling sleeve (7) consists of plastic and is applied to the tie rod in an injection moulding method. As an alternative, coupling sleeve and tie rod are produced in one piece, for example by machining from metal or in an injection moulding method. The coupling sleeve is equipped with a radial transverse-groove opening (8) which serves for the plugging therethrough, and then rotation, of the connection piece tabs. FIG. 1*a*-2 shows an enlarged top view of the coupling sleeve. FIG. 1*a*-3 shows by way of example the perspective view of a tie rod/coupling sleeve combination according to embodiment 1a. The radial transverse-groove opening (8) for the plugging therethrough, and then rotation, of the connection piece tabs (5) can be seen at the end of the component.

FIG. 1*b* shows by way of example embodiment 1b of the metering pump according to the invention. Coupling sleeve and tie rod are fixedly connected by flanging. During the flanging, the fold (9) is formed.

The cross sections of the construction which are denoted by A-A and B-B in FIG. 1*b* are schematically shown in FIG. 1*b*-A (cross section A-A) and FIG. 1*b*-B (cross section B-B).

FIG. 1*b*-A shows a cross section at the transverse-groove opening (8) of the coupling sleeve (7). What is shown is the axial guidance of the connection piece (4), and, schematically, the connection piece tabs (5) after rotation of the diaphragm (1) and diaphragm core (2).

FIG. 1*b*-B shows a cross section through the coupling sleeve (7). The connection piece (4) and the connection piece tabs (5) are also shown. Those surfaces of the connection piece tabs (5) which point in the direction of the diaphragm are inclined by 1°–3°, ensuring axial freedom from play (not shown).

FIG. 1*c* shows by way of example embodiment 1c of the metering pump according to the invention. Coupling sleeve (7) and tie rod (3) have, on their outer side and inner side, respectively, a thread (10) and are screwed directly to one another.

FIG. 1*d* shows by way of example embodiment 1d of the metering pump according to the invention. Coupling sleeve (7) and tie rod (3) are connected by screwing (11).

FIG. 1*e* shows by way of example the perspective view of an assembled diaphragm according to one of embodiments 1a-1d. Diaphragm core (2), connection piece (4) and connection piece tabs (5) can be seen.

FIG. 2*a*-1 and FIG. 2*a*-2 show by way of example cross sections, denoted by A-A, of embodiment 2a of the metering pump according to the invention, wherein the diaphragm core (2) is provided, in the direction of the tie rod (3), with a preferably cylindrical coupling member (12), wherein the coupling member has a groove (13). The tie rod is provided on the end side with a first (axial) opening (14) for receiving the coupling member (12) and has a second (radial) opening (15) which is used for receiving the component (16) intended for the fixing of the coupling member (12). The fixing of the coupling member (12) is effected by means of a displaceable component (16) which engages "in a lock-like manner", by way of a hook (44) in the shape of a crescent, into the groove (13) of the coupling member due to the pressure of a compression spring (17).

FIG. 2*a*-1 shows the construction before, and FIG. 2*a*-2 shows the construction after, the coupling member (12) has been engaged.

FIG. 2*a*-3 and FIG. 2*a*-4 schematically show the cross sections denoted by C-C, D-D and E-E in FIG. 2*a*-1 and FIG. 2*a*-2 through the longitudinal axis of tie rod (3) and coupling member (12). It can also be seen that the removal of the coupling member is effected by means of a pin (18), which the fitter plugs from the outside through a bore in the diaphragm retaining plate (or in the drive housing) (bore not shown). Thereafter, the displaceable component (16) is displaced downwards, the coupling member (12) becomes free and can be pulled out. FIG. 2*a*-3 and FIG. 2*a*-4 also show that, in order to orient the displaceable component (16) parallel to the tie rod axis, the construction has a cylindrical pin (40). The cylindrical opening (41) of the component (16) must be oriented on the axis of the tie rod (3) in order to enable axial plugging-in of the coupling member (12). In the absence of the cylindrical pin (40), the position of the opening (41) in the component (16) would be undefined.

FIG. 2*a*-5 schematically shows the perspective view of an assembled diaphragm according to embodiment 2a of the metering pump according to the invention.

FIG. 2*a*-6 shows various perspective views and associated cross sections, denoted by A-A and B-B, of the displaceable component (16) according to embodiment 2a of the metering pump according to the invention. The opening (43) for the pin (40) can be seen.

FIG. 2*b* shows by way of example embodiment 2b of the metering pump according to the invention, wherein the diaphragm core (2) is provided, in the direction of the tie rod (3), with a cylindrical coupling member (12), wherein the coupling member has a groove (13). The tie rod (3) is provided on the end side with an axial opening (14) for receiving the coupling member (12) and with two radial grooves (22) for receiving a clamp coupling (19). The fixing of the coupling member (12) is effected by means of a clamp coupling (19) which is secured against rotation.

The cross section, denoted by A-A in FIG. 2*b*, of the construction is schematically shown in FIG. 2*b*-1.

FIG. 2*b*-1 shows that the clamp coupling (19) consists of two clamp halves braced with a spring (20). The clamp coupling (19) is assembled on two parallel transverse grooves (22) of the tie rod (3). The surfaces (21) of the two transverse grooves serve as anti-rotation means for the clamp coupling (19).

FIG. 2*c*-1 shows by way of example embodiment 2c-1 of the metering pump according to the invention. The tie rod (3) has a radial transverse bore (23) into which a resiliently mounted ball (24), such as a resilient pressure piece according to the Ganter Norm®, is introduced. The coupling member (12) has an obliquely running transverse groove (13) of variable depth. The coupling member (12) and the tie rod (3) are connected by being plugged into one another and subsequently rotated in opposite directions. During the rotation, the ball (24) dips into the groove (13) until it is engaged in its end position and the coupling member is fixed.

FIG. 2*c*-2 shows a variant (embodiment 2c-2) of the above-described embodiment 2c-1 of the metering pump according to the invention. In this case, the coupling member (12) has a radial transverse bore (23) into which a resiliently mounted ball (24), such as a resilient pressure piece according to the Ganter Norm®, is introduced. The tie rod has a transverse groove (25). The functioning in this embodiment 2c-2 corresponds to that of embodiment 2c-1. The ball engages in the groove (25). The width of the groove (25) determines the angle of rotation for orienting the diaphragm.

FIG. 2*d* shows by way of example embodiment 2d of the metering pump according to the invention. The tie rod has one or more radial transverse bores (26) into which a respective grub screw (27) (set screw according to DIN 913) is screwed. The coupling member (12) has a radially encircling groove (28) for receiving the screw tip.

FIG. 3*a* shows by way of example embodiment 3a of the metering pump according to the invention, comprising diaphragm (1) and diaphragm core (2), wherein the diaphragm core (2) is provided, in the direction of the tie rod (3), with a clamping connection piece (29) which is able to be screwed in, a clamping groove (35) is worked into the tie rod (3) and the end side of the tie rod (3) is provided with a clamping connection (30) which is driven by a compression spring (39). The clamping connection has a first clamping hub (31) and a second clamping hub (32), wherein the first clamping hub (31) is worked into the tie rod itself, and the second clamping hub (32) is radially displaceable and able to be fixed. The fixing is preferably effected with a screw (33) having a thread (42).

FIG. 3*b* shows by way of example embodiment 3b of the metering pump according to the invention, wherein the diaphragm core (2) has, in the direction of the tie rod (3), a clamping connection piece (29) which is able to be screwed in and the end side of the tie rod (3) has an axially displaceable coupling sleeve (34) which, displaced in the direction of the diaphragm core, clamps the clamping connection piece (29) in the clamping groove (35) worked into the tie rod. A resiliently mounted ball (37), such as a resilient pressure piece according to the Ganter Norm®, is also introduced into a radial transverse bore (36) of the tie rod (3). A corresponding depression (38) for receiving the ball is located in the coupling sleeve (34).

The features of the invention disclosed in the above description, in the claims and in the drawings may be essential both individually and in any desired combination for the realization of the invention in its various embodiments.

The invention claimed is:

1. A metering pump comprising (i) a diaphragm return device comprising tie rod (3) and (ii) a diaphragm assembly comprising a mechanically driven elastic diaphragm (1) having a flexible region between the clamping surface, which serves to seal the delivery chamber, at the periphery of the diaphragm and a diaphragm core (2) which serves for force transmission, pressure generation and for connection to the tie rod, wherein the diaphragm assembly and the tie rod are connected by a hook coupling, and wherein the diaphragm core (2) is provided, in the direction of the tie rod (3), with a cylindrical connection piece (4) which bears two oppositely positioned tabs (5) at the end, the tie rod (3) is provided on the end side with an axial turned-out portion (6) for receiving the connection piece tabs (5), and the tie rod (3) is equipped with a coupling sleeve (7) which has a radial transverse-groove opening (8), wherein the opening serves for the plugging therethrough, and then rotation, of the connection piece tabs.

2. The metering pump according to claim 1, wherein the coupling sleeve (7) and tie rod (3) consist of one piece.

3. The metering pump according to claim 2, wherein the coupling sleeve (7) and tie rod (3) consist of metal.

4. The metering pump according to claim 2, wherein the coupling sleeve (7) and tie rod (3) consist of plastic or the coupling sleeve consists of plastic and the tie rod consists of metal.

5. The metering pump according to claim 1, wherein the coupling sleeve (7) is connected to the tie rod (3) by flanging.

6. The metering pump according to claim 1, wherein the coupling sleeve (7) is screwed directly to the tie rod (3) via a thread (10).

7. The metering pump according to claim 1, wherein the coupling sleeve (7) is fastened to the tie rod (3) with screws (11).

8. A metering pump comprising (i) a diaphragm return device comprising tie rod (3) and (ii) a diaphragm assembly comprising a mechanically driven elastic diaphragm (1)

having a flexible region between the clamping surface, which serves to seal the delivery chamber, at the periphery of the diaphragm and a diaphragm core (2) which serves for force transmission, pressure generation and for connection to the tie rod, wherein the diaphragm assembly and the tie rod are connected by means of a plug-in coupling, and wherein the diaphragm core (2) is provided, in the direction of the tie rod (3), with a cylindrical coupling member (12), wherein the coupling member has a groove (13), the tie rod (3) is provided on the end side with a first-axial-opening (14) for receiving the coupling member (12), and the tie rod has a second-radial-opening (15) which is used for the fixing of the coupling member (12).

9. The metering pump according to claim 8, wherein, for the fixing of the coupling member (12), a displaceable component (16) is arranged in the tie rod (3), said displaceable component engaging in a lock-like manner into the groove (13) of the coupling member (12) due to the pressure of a compression spring (17).

10. The metering pump according to claim 8, wherein, for the fixing of the coupling member (12), a clamp coupling (19) is arranged on the tie rod (3), said clamp coupling consisting of two clamp halves braced with a spring (20) and being mounted on two parallel transverse grooves (22) of the tie rod (3).

11. The metering pump according to claim 8, wherein, for the fixing of the coupling member (12), a resiliently mounted ball (24) is introduced into a radial transverse bore (23) of the tie rod (3) and the groove (13) in the coupling member is an obliquely running transverse groove of variable depth.

12. The metering pump according to claim 11, wherein the resiliently mounted ball (24, 37) is a resilient pressure piece.

13. The metering pump according to claim 11, wherein the resiliently mounted ball (24) is screwed into a radial transverse bore (23) of the tie rod (3).

14. The metering pump according to claim 8, wherein the diaphragm core (2) is provided, in the direction of the tie rod (3), with a cylindrical coupling member (12), the tie rod (3) is provided on the end side with a first-axial-opening (14) for receiving the coupling member (12), the tie rod has a transverse groove (25), and, for the fixing of the coupling member, a resiliently mounted ball (24) is introduced into a radial transverse bore (23) of the coupling member.

15. The metering pump according to claim 14, wherein the resiliently mounted ball (24) is screwed into the radial transverse bore (23) of the coupling member.

16. The metering pump according to claim 8, wherein, for the fixing of the coupling member (12), a respective grub screw (27) is screwed into one or more radial transverse bores (26) of the tie rod (3) and the coupling member has a radially encircling groove (28) for receiving the screw tip.

17. A metering pump comprising (i) a diaphragm return device comprising tie rod (3) and (ii) a diaphragm assembly comprising a mechanically driven elastic diaphragm (1) having a flexible region between the clamping surface, which serves to seal the delivery chamber, at the periphery of the diaphragm and a diaphragm core (2) which serves for force transmission, pressure generation and for connection to the tie rod, wherein the diaphragm assembly and the tie rod are connected by means of a clamping connection, and wherein the diaphragm core (2) is provided, in the direction of the tie rod (3), with a clamping connection piece (29) which is able to be screwed in, a clamping groove (35) is worked into the tie rod (3), and the end side of the tie rod (3) is provided with a clamping connection (30) which has a first clamping hub (31) and optionally a second clamping hub (32), wherein the first clamping hub (31) is worked into the tie rod (3) itself, and the optional second clamping hub (32) forms a separate part which is fastened by screw fastening.

18. The metering pump according to claim 17, wherein the clamping connection (30) has a radially displaceable second clamping hub (32), wherein the second clamping hub (32) is able to be fixed.

19. The metering pump according to claim 17, wherein the clamping connection (30) has an axially displaceable coupling sleeve (34) which, displaced in the direction of the diaphragm core (2), clamps the clamping connection piece (29) in the clamping groove (35) worked into the tie rod, a resiliently mounted ball (37) is introduced into a radial transverse bore (36) of the tie rod (3), and a corresponding depression (38) for receiving the ball (37) is located in the coupling sleeve.

* * * * *